US005895147A

United States Patent [19]

Facci et al.

[11] Patent Number: 5,895,147

[45] Date of Patent: Apr. 20, 1999

[54] ROLL CHARGER WITH SEMI-PERMEABLE MEMBRANE FOR LIQUID CHARGING

[75] Inventors: John S. Facci; Michael J. Levy, both of Webster; Joseph Mammino, Pentfield, all of N.Y.

[73] Assignee: Xerox Corporation, Stamford, Conn.

[21] Appl. No.: 08/974,098

[22] Filed: Nov. 19, 1997

[51] Int. Cl.[6] ..... G03G 15/02

[52] U.S. Cl. ..... 399/174; 399/176

[58] Field of Search ..... 399/176, 168, 399/237, 240, 249, 135, 174; 361/225

[56] References Cited

U.S. PATENT DOCUMENTS

| | | | |
|---|---|---|---|
| 5,321,471 | 6/1994 | Ito et al. | 399/129 |
| 5,406,356 | 4/1995 | Campbell et al. | 399/127 |
| 5,424,813 | 6/1995 | Schlueter, Jr. et al. | 399/249 X |
| 5,493,369 | 2/1996 | Sypula et al. | 399/240 |
| 5,510,879 | 4/1996 | Facci et al. | 399/168 |

FOREIGN PATENT DOCUMENTS 8-62932 3/1996 Japan .

*Primary Examiner*—Arthur T. Grimley
*Assistant Examiner*—Quana Grainger
*Attorney, Agent, or Firm*—Tamera L. Fair; Christopher D. Wait

[57] ABSTRACT

An electrostatographic printing machine and apparatus that utilizes a two layer roll charger for contact charging of photoreceptors. The charger includes a liquid retentive foam layer fitted over an electrically conductive shaft. The shaft can be solid or porous, the later requiring a separate liquid reservoir. The second layer is a thin liquid permeable member, over the foam layer, which transmits water at a slow, but controlled rate during the rotation of the roller. The roller may rotate synchronously with the photoreceptor or be allowed to slip on the photoreceptor surface to improve uniformity and contact. The membrane increases life by controlling the runout of liquid from the repository. Also, the present invention permits charging over photoreceptor pinholes.

34 Claims, 2 Drawing Sheets

ROLL CHARGER WITH SEMI-PERMEABLE MEMBRANE FOR LIQUID CHARGING

CROSS-REFERENCE

Cross-reference is made to and priority is claimed from U.S. patent application Ser. No. 08/974,097 (Attorney's Docket No. 97185) entitled "Web Liquid Charging: Improved Resistance To Contamination" by Facci et al.; U.S. patent application Ser. No. 08/974,099 (Attorney's Docket No. D/97192) entitled "Control of Fluid Carrier Resistance and Water Concentration in an Aquatron Charging Device" by Facci et al.; and U.S. patent application Ser. No. 08/974,663 (Attorney's Docket No. 97533) entitled "Method for Improving Charging Uniformity of an Aquatron" by Levy et al., each assigned to the same assignee as the present application.

This invention relates generally to an apparatus for depositing a substantially uniform charge on an adjacent surface, and, more particularly, concerns an apparatus for enabling ion transfer via ionic conduction through an ionically conductive liquid, primarily for use in electrostatographic applications, for example, for charging an imaging member such as a photoreceptor or a dielectric charge receptor.

BACKGROUND OF THE INVENTION

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original. The original is subsequently developed into a visible image by a process in which a charged developing material is deposited onto the photoconductive surface of the photoreceptor such that the developing material is attracted to the charged image areas on the photoconductive surface. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images.

Various devices and apparatus have been proposed for use in electrostatographic applications to apply an electrostatic charge or a charge potential to a photoconductive surface prior to the formation of a light image thereon. Typically, corona generating devices are utilized, wherein a suspended electrode comprising one or more fine conductive elements is biased at a high electric potential, causing ionization of surrounding air which results in deposition of an electric charge on an adjacent surface. An example of such a corona generating device is described in U.S. Pat. No. 2,836,725 to R. G. Vyverberg, wherein a conductive corona electrode in the form of an elongated wire is partially surrounded by a conductive shield. The corona electrode is provided with a DC voltage, while the conductive shield is usually electrically grounded. A dielectric surface to be charged is spaced from the wire on the side opposite the shield and is mounted on a grounded substrate. Alternatively, the corona device may be biased in a manner taught in U.S. Pat. No. 2,879,395, wherein an AC corona generating potential is applied to the conductive wire electrode and a DC potential is applied to a conductive shield partially surrounding the electrode. This DC potential regulates the flow of ions from the electrode to the surface to be charged. Because of this DC potential, the charge rate can be adjusted, making this biasing system ideal for self regulating systems. Other biasing arrangements are known in the prior art and will not be discussed in great detail herein.

In addition to charging the imaging surface of an electrostatographic system prior to exposure, corona generating devices, so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy.

Several problems have historically been associated with corona generating devices as described hereinabove. The most notable problem centers around the inability of such corona devices to provide a uniform charge density along the entire length of the corona generating electrode, resulting in a corresponding variation in the magnitude of charge deposited on associated portions of the adjacent surface to be charged. Other problems include the use of very high voltages (6000–8000 V) requiring the use of special insulation, maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on corona devices. More importantly, corona devices generate ozone, resulting in well-documented health and environmental hazards. Corona charging devices also generate oxides of nitrogen which eventually desorb from the corotron and oxidize various machine components, thereby adversely effecting the quality of the final output print.

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martel et al., have been disclosed and discussed in numerous articles of technical literature.

The present invention relates to a device for charging photoconductive imaging members by ionic conduction through a fluid media, wherein corona generating devices together with their known disadvantages can be avoided. The following disclosures may be relevant to various aspects of the present invention and may be briefly summarized as follows:

U.S. Pat. No. 5,602,626 to Facci et al. discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,561,505 to Lewis discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a mechanically sealable housing adapted to permit movement of the wetted donor blade from an operative position in contact with the charge retentive surface, to a nonoperative position stored within the housing to prevent loss of the tonically conductive liquid in its liquid or vapor form so as to extend the functional life of the apparatus. In one specific embodiment, a wiper blade may be provided for removing any liquid droplets from the surface of the photoreceptor as may have been transferred at the donor blade/charge retentive surface interface.

U.S. Pat. No. 5,457,523 to Facci et al. discloses a device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized to selectively control the activation of the charging process.

U.S. Pat. No. 5,045,890 to DeBolt et al. discloses a fuser apparatus for heat fusing toner images to a print substrate that has a fuser roll and a pressure roll forming a fusing nip therebetween, a system to deliver liquid release agent to the fuser roll including a movable web having a first side and a second side supported between a web supply roll and a web take-up roll, a housing supporting the supply roll and take-up roll is on one side of the fuser roll and the other is on the movable web is in contact with the fuser roll along a path parallel to its longitudinal axis. The movable web is impregnated with a liquid release agent and the movable web, supply roll and take-up roll are reversibly mounted in the housing to deliver liquid release agent to the fuser roll initially from the first side of the movable web followed by reversing the location of the supply roll and take-up roll in the support housing so that the second side of the impregnated web is in contact with the fuser roll to deliver release agent. The movable web is urged into delivery engagement with the fuser roll by an open celled foam pinch roll impregnated with liquid release agent.

SUMMARY OF INVENTION

Briefly stated, and in accordance with one aspect of the present invention, there is provided an apparatus for applying an electrical charge to an imaging surface having movement, comprising: a roll comprising layers, having a first layer, being a liquid retentive member, and a second layer, being a liquid permeable membrane over the first layer; and an electrically conductive shaft about which the first layer is fitted.

Pursuant to another aspect of the present invention, there is provided an electrostatographic printing machine including an apparatus for applying an electrical charge to an imaging surface having movement, comprising: a roll comprising layers, having a first layer, being a liquid retentive member, and a second layer, being a liquid permeable membrane over the first layer; and an electrically conductive shaft about which the first layer is fitted.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
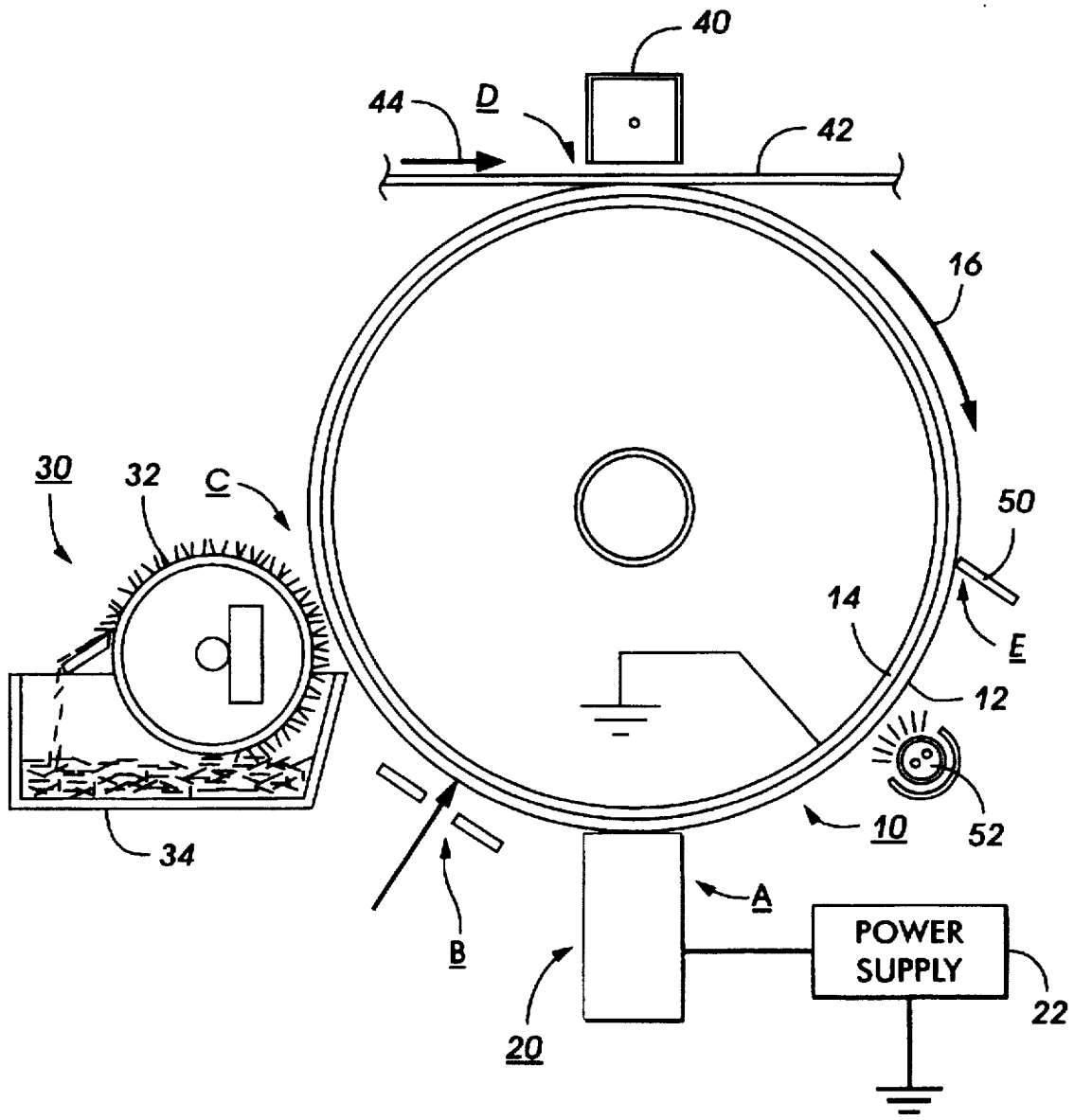
FIG. 3 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 3 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 3 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A. At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (riot shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station F can include various mechanisms, such as a simple blade 50, as shown, or a rotatably mounted fibrous brush (not shown) for physical engagement with photoconductive surface 12 to remove toner particles therefrom. Cleaning station F may also include a discharge lamp (not shown) for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

Liquid (e.g. aquatron) charging is an ozone-free contact charging technique that is based on electrification of a water (or other liquid) moistened contact pad on the photoreceptor surface. Aquatron charging generates less than 0.005 μg/min. Its advantage over other contact charging techniques in that it provides excellent charging uniformity over a wide range of process speeds, e.g. to 50 ips and is DC-only. It is nearly 100% efficient, operating at near theoretical voltage and current levels.

Figure 1:
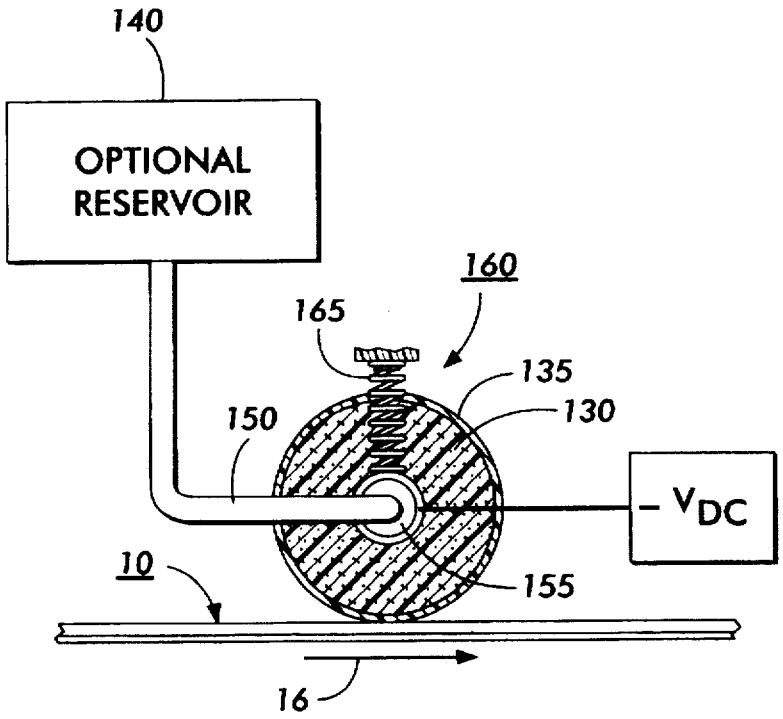
FIG. 1 is a schematic of roll charger for liquid charging.

Reference is now made to FIG. 1, which schematically shows a roll charger for liquid charging. A two layer roll charger 160 is used for DC contact charging of a photoreceptor 10. (A DC charge is used to minimize power supply costs and insure charge uniformity.) The first layer of the present invention is a repository for holding a reasonably large quantity of liquid such as water. It is composed of an open cell foam 130 that is a liquid retentive material. For example, polyvinylalcohol (PVA) based foam is capable of holding ten (10) times its weight in liquid. Other materials are also suitable.

With continued reference to FIG. 1, the liquid (e.g. water) retentive foam layer 130 of the roll charger 160 is fitted over an electrically conductive shaft 155. The shaft 155 is either solid or porous to provide liquid to the foam layer 130. A liquid permeable membrane 135 covers the foam layer 130. Spring 165 pressure is used to maintain proper contact between the roll charger 160 and the photoreceptor 10. In one embodiment of the present invention, the foam layer 130 is fitted over the top of a solid (i.e. non-porous) electrically conductive shaft. In addition to providing rigidity for the liquid charger, the shaft serves as the high voltage connection to the roll charger 160. The corrosion resistant shaft materials include aluminum, stainless steel, brass and electrically conductive carbon-filled composite materials. In this embodiment, the device is totally self-contained (i.e. all the liquid is contained within the device and no external reservoir is provided). In a self-contained device, the liquid supply is designed to last the life of the CRU. If an external reservoir is used, the liquid supply will last the life of the photoreceptor or as long as needed.

The roller may either idle on the photoreceptor surface or be driven synchronously or asynchronously (with a slight amount of slip). As it rolls over the photoreceptor 10, the membrane 135 releases a small quantity of liquid (e.g. water) which is electrified by the high voltage contact. The electrified liquid in turn charges the photoreceptor surface, similar in operation to an aquatron charging device. The advantage of the liquid permeable membrane 135 is that the volume of liquid used during charging can be minimized. The quantity of water used is preferably about 0.5 microliters per panel (e.g. 8.5 inches×11 inches document:). For example, about 20 ml of water (fluid) would be required for 20,000 copies/prints using 1 microliter of fluid per 8.5 inches×11 inches document.

In order to extend the life of the present invention even further, a porous shaft may be substituted for the solid shaft and a connection provided to an external (e.g. gravity fed) reservoir 140. The liquid provided to the porous shaft flows from a reservoir 140 through a pipe 150 that connects the reservoir 140 and the shaft 155. Liquid is dispensed to the foam layer 130 from the porous shaft. A constant liquid capacity can be kept within the foam layer 135 in this way. The external reservoir also extends the capacity and life of the roll charger beyond that of the "self-contained" roll charger described above.

Finally because of the potential for roll contamination, use of a cleaner to wipe off toner, paper etc. from the roll may be necessary. Because the cleaner places a drag on the system, a slightly slipping contact rather than a synchronous contact results. This results in better contact with the surface and more uniform charging.

With continuing reference to FIG. 1, the foam layer 130 is coated with a thin liquid (e.g. water) permeable membrane 135 which transmits liquid at a slow but controlled rate, similar to the operation of a fuser oil donor roll. The roll charger 160 may rotate synchronously with the photoreceptor 10 or be allowed to slip on the surface of the photoreceptor to improve uniformity and contact. The roll charger 160 maintains the usual advantages of liquid charging (e.g. ozone-free, no AC power supply, high charge uniformity, low power, wide process speed, and low cost). Additionally, the permeable membrane 135 increases life, especially for low volume applications, by controlling the runout of liquid from the reservoir 140. It also permits charging over photoreceptor pinholes as shown in FIG. 2.

Figure 2:
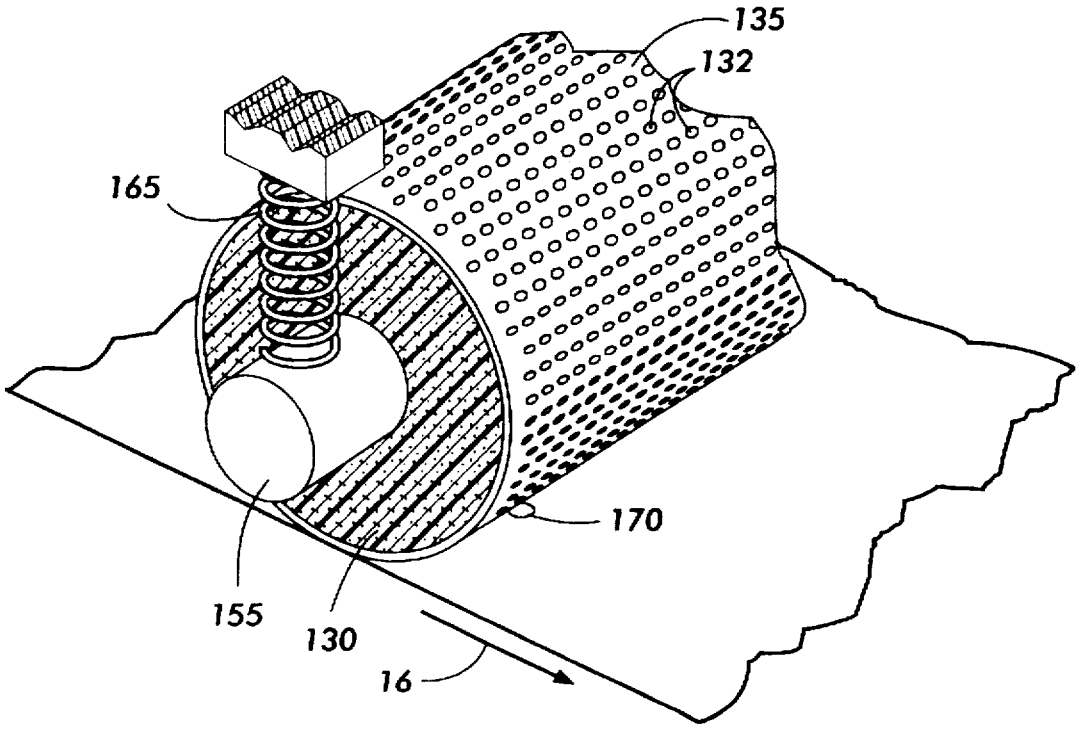
FIG. 2 is a schematic of the occurrence of current limitation when charging over a photoreceptor pinhole.

Reference is now made to FIG. 2, which schematically shows how current limitation can occur when the micropores 132 of a semi-permeable membrane 135 is located over a photoreceptor pinhole 17. A liquid permeable membrane 135, especially one with a microporous structure, could also be advantageous in terms of charging over pinholes. The liquid within the pores 132 of the membrane 135 is expected to have a high electrical resistance because of its narrow diameter. Limiting the current flow prevents loading of the power supply. When the power supply is loaded, its output voltage decreases substantially, such that the whole photoreceptor in contact with the roll at the time of contact with the pinhole will be charged to a substantially lower voltage resulting in a print defect known as a pinhole deletion. If a pore or a collection of pores of small size were to be located over a photoreceptor pinhole 170, the high impedance of these pores could limit current flow to the pinhole, thus enabling charging over defects in the photoreceptor 10.

A roll charger is practical for low volume black and white copier/printer or color copier/printer (with a tandem engine arrangement or an Intermediate Transfer Belt) applications. A roll charger provides a lower cost alternative to a sensor and a pump arrangement needed to achieve rapid water delivery and moisture control at mid and high volumes, disclosed in U.S. patent application Ser. No. 08/974,099 (Attorney's Docket No. D/97192) entitled "Control of Fluid Carrier Resistance and Water Concentration in an Aquatron Charging Device" by Facci et al. Total system cost may also be reduced by the present aquatron because the need for an AC power supply (i.e. bias charge rolls) and other contact charging techniques use AC+DC) and ozone filter (this assuming that transfer is also ozone-free (e.g. roll transfer)) is eliminated.

In recapitulation, the present invention utilizes a two layer roll charger for contact charging of photoreceptors. The charger includes a liquid retentive foam layer fitted over an electrically conductive shaft. The shaft can be solid or porous, depending upon whether or not a separate liquid reservoir is used. The second layer is a thin liquid permeable member, over the foam layer, which transmits water at a slow, but controlled rate during the rotation of the roller. (Water is not transmitted when the roller is idle.) The roller may rotate synchronously with the photoreceptor or be allowed to slip on the photoreceptor surface to improve uniformity and contact. This charger has the advantages of liquid charging such as being ozone-free, no AC power supply, high charge uniformity, low power, wide process speed and low cost. The membrane increases life by controlling the runout of liquid from the repository. Also, the present invention permits charging over photoreceptor pinholes.

It is, therefore, apparent that there has been provided in accordance with the present invention, a roll charger with a permeable membrane for liquid charging that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for applying an electrical charge, comprising:

an ionically conductive liquid, a photoreceptor with a charge receiving photoreceptor surface, a roll in contact with said photoreceptor surface, said roll comprising layers, having a first layer, being a liquid retentive member holding said ionically conductive liquid whereby a repository of ionically conductive liquid is provided, and a second layer, being a liquid permeable membrane over said first layer, said second layer in contact with said photoreceptor surface, releasing said ionically conductive liquid to said photoreceptor surface, and:

an electrically conductive shaft about which said first layer is fitted.

2. An apparatus as recited in claim 1, wherein said liquid retentive member includes an open cell foam material.

3. An apparatus as recited in claim 1, wherein said electrically conductive shaft is non-porous.

4. An apparatus as recited in claim 3, wherein said non-porous electrically conductive shaft being substantially rigid for liquid charging of the imaging surface.

5. An apparatus as recited in claim 4, further comprising a bias source to provide a high voltage connection with said non-porous electrically conductive shaft to said roll.

6. An apparatus as recited in claim 5, wherein said roll being self-contained comprises a sufficient supply of liquid therein, for liquid charging of the imaging surface.

7. An apparatus as recited in claim 6, wherein said liquid permeable membrane of said roll, being in contact with the imaging surface, releases a sufficient quantity of liquid to the imaging surface that has been electrified by the high voltage connection of said bias source across said non-porous electrically conductive shaft and said roll to charge the imaging surface.

8. An apparatus as recited in claim 7, wherein the sufficient quantity of liquid comprises a release of about 0.5 microliter to about 5 microliters of liquid per 8.5"×11" document.

9. An apparatus as recited in claim 7, wherein said liquid permeable membrane minimizes a volume of liquid required during charging of the imaging surface.

10. An apparatus as recited in claim 1, wherein said electrically conductive shaft is porous.

11. An apparatus as recited in claim 10, wherein said porous electrically conductive shaft is connected to a bias source to provide a high voltage connection to said roll.

12. An apparatus as recited in claim 11, further comprising:

a reservoir of liquid separate from said roll; and a conduit being connected between said reservoir and said roll to transport the liquid from said reservoir to said roll.

13. An apparatus as recited in claim 12, wherein said conduit transports the liquid from said reservoir to said porous electrically conductive shaft for dispensing to said first layer of said roll, said first layer of said roll being fitted about said porous electrically conductive shaft.

14. An apparatus as recited in claim 13, wherein the liquid being dispensed to said first layer of said roll through said porous electrically conductive shaft provides a constant liquid capacity to said first layer of said roll.

15. An apparatus as recited in claim 14, wherein said liquid permeable membrane of said roll, being in contact with the imaging surface, releases a sufficient quantity of liquid to the imaging surface that has been electrified by the high voltage connection of said porous electrically conductive shaft to said roll to charge the imaging surface.

16. An apparatus as recited in claim 15, wherein the contact between said roll and the imaging surface, each having rotational movement, is synchronous.

17. An apparatus as recited in claim 15, wherein the contact between said roll and the imaging surface, each having rotational movement, is asynchronous having minimal slip therebetween.

18. An apparatus as recited in claim 15, wherein the sufficient quantity of liquid comprises a release of about 0.5 microliter to about 5 microliters of liquid per 8.5"×11" document.

19. An apparatus as recited in claim 15, wherein said liquid permeable membrane minimizes a volume of liquid required during charging of the imaging surface.

20. An electrostatographic printing machine including an apparatus for applying an electrical charge, comprising:

an ionically conductive liquid, a photoreceptor with a charge receiving photoreceptor surface, a roll in contact with said photoreceptor surface, said roll comprising layers, having a first layer, being a liquid retentive member holding said ionically conductive liquid whereby a repository of ionically conductive liquid is provided, and a second layer, being a liquid permeable membrane over said first layer, said second layer in contact with said photoreceptor surface, releasing said ionically conductive liquid to said photoreceptor surface, an electrically conductive shaft about which said first layer is fitted, and;

a bias source applied across a series string comprising said electrically conductive shaft, said liquid retentive member, said liquid permeable membrane, said ionically conductive liquid, and said photoreceptor surface, whereby ions are supplied to said photoreceptor surface by ionic conduction via said ionically conductive liquid.

21. An electrostatographic printing machine as recited in claim 20, wherein said liquid retentive member includes an open cell foam material.

22. An electrostatographic printing machine as recited in claim 20, wherein said electrically conductive shaft is non-porous.

23. An electrostatographic printing machine as recited in claim 22, wherein said non-porous electrically conductive shaft being substantially rigid for liquid charging of the imaging surface.

24. An electrostatographic printing machine as recited in claim 23, wherein said roll being self-contained comprises a sufficient supply of liquid therein, for liquid charging of the imaging surface.

25. An electrostatographic printing machine as recited in claim 24, wherein the sufficient quantity of liquid comprises a release of about 0.5 microliter to about 5 microliters of liquid per 8.5"×11" document.

26. An electrostatographic printing machine as recited in claim 24, wherein said liquid permeable membrane minimizes a volume of liquid required during charging of the imaging surface.

27. An electrostatographic printing machine as recited in claim 20, wherein said electrically conductive shaft is porous.

28. An electrostatographic printing machine as recited in claim 27, wherein said porous electrically conductive shaft comprises a bias to provide a high voltage connection to said roll.

29. An electrostatographic printing machine as recited in claim 28, further comprising:

a reservoir of liquid separate from said roll; and a conduit being connected between said reservoir and said roll to transport the liquid from said reservoir to said roll.

30. An electrostatographic printing machine as recited in claim 29, wherein said conduit transports the liquid from said reservoir to said porous electrically conductive shaft for dispensing to said first layer of said roll, said first layer of said roll being fitted about said porous electrically conductive shaft.

31. An electrostatographic printing machine as recited in claim 30, wherein the liquid being dispensed to said first layer of said roll through said porous electrically conductive shaft provides a constant liquid capacity to said first layer of said roll.

32. An electrostatographic printing machine as recited in claim 31, wherein said liquid permeable membrane of said roll, being in contact with the imaging surface, releases a sufficient quantity of liquid to the imaging surface that has been electrified by the high voltage connection of said porous electrically conductive shaft to said roll to charge the imaging surface.

33. An electrostatographic printing machine as recited in claim 32, wherein the sufficient quantity of liquid comprises a release of about 0.5 microliter to about 5 microliters of liquid per 8.5"×11" document.

34. An electrostatographic printing machine as recited in claim 32, wherein said liquid permeable membrane minimizes a volume of liquid required during charging of the imaging surface.

* * * * *